United States Patent [19]

Fischer

[11] Patent Number: 4,491,612

[45] Date of Patent: Jan. 1, 1985

[54] FINISHING LEATHER OR A SYNTHETIC LEATHER SUBSTITUTE

[75] Inventor: Karl Fischer, Bad Durkheim, Fed. Rep. of Germany

[73] Assignee: BASF Aktiengesellschaft, Ludwigshafen, Fed. Rep. of Germany

[21] Appl. No.: 517,438

[22] Filed: Jul. 26, 1983

[30] Foreign Application Priority Data

Jul. 28, 1982 [DE] Fed. Rep. of Germany ..... 3228128
Mar. 3, 1983 [DE] Fed. Rep. of Germany ..... 3307431

[51] Int. Cl.[3] ..... B05D 3/02

[52] U.S. Cl. ..... 427/412; 8/94.21; 428/473

[58] Field of Search ..... 427/389, 412; 8/436, 8/94.21; 428/473

[56] References Cited

U.S. PATENT DOCUMENTS

| | | | |
|---|---|---|---|
| 2,884,336 | 4/1959 | Loshaek et al. | 427/389 X |
| 3,403,119 | 9/1968 | Sullivan et al. | 260/28.5 |
| 3,919,451 | 11/1975 | Levy et al. | 427/412 X |
| 4,256,809 | 3/1981 | Larsson et al. | 427/412 |

FOREIGN PATENT DOCUMENTS

| | | |
|---|---|---|
| 1275872 | 10/1961 | France . |
| 1325985 | 3/1963 | France . |

OTHER PUBLICATIONS

European Search Report of Application No. 83107140.2-(Applicant BASF Aktiengesellschaft).
Chemical Abstracts, vol. 85, 1976, p. 74 (179009g), "A Novel Finish for Leathers".

*Primary Examiner*—Thurman K. Page
*Attorney, Agent, or Firm*—Oblon, Fisher, Spivak, McClelland & Maier

[57] ABSTRACT

Leather or a synthetic leather substitute is finished by applying a bottoming based on an aqueous acrylic resin dispersion, drying the coating and then applying a season containing an aqueous styrene/acrylate dispersion, by a process wherein the dispersion used in the bottoming procedure comprises one or more copolymers (a) which contain, as copolymerized units, from 30 to 85% by weight of a $C_2$–$C_6$-alkyl acrylate or methacrylate, from 1 to 8% by weight of a carboxyl-containing monomer and from 7 to 65% by weight of one or more monomers, which are copolymerizable with the above monomers, from the group comprising acrylonitrile, acrylamide, methacrylamide, vinyl chloride, vinyl acetate and styrene, the percentages being based on the copolymer, and a copolymer (b) which contains, as copolymerized units, from 50 to 90% by weight of vinylidene chloride, from 10 to 50% by weight of a $C_2$–$C_4$-alkyl acrylate or methacrylate and from 1 to 5% by weight of N-methylolacrylamide or —methacrylamide which carries a group capable of crosslinking the copolymer, with or without from 1 to 5% by weight of acrylamide or methacrylamide, the percentages being based on the copolymer, or the composition contains, in dispersed form, from 50 to 90% by weight of vinyl chloride and from 10 to 50% by weight of a $C_1$–$C_4$-alkyl acrylate or methacrylate as well as from 0 to 5% by weight of acrylamide or methacrylamide in the ratio a:b of from 2:1 to 5:1, and the season used is a dispersion which contains a divalent metal ion and, in dispersed form, a copolymer (c) which contains, as copolymerized units, from 20 to 40% by weight of styrene, from 50 to 75% by weight of one or more $C_1$–$C_6$-alkyl acrylates or methacrylates, from 1 to 10% by weight of acrylic acid or methacrylic acid and from 1 to 5% by weight of N-methylolacrylamide or —methacrylamide which carries a group capable of crosslinking the copolymer, the percentages being based on the copolymer.

2 Claims, No Drawings

FINISHING LEATHER OR A SYNTHETIC LEATHER SUBSTITUTE

The present invention relates to a novel process for finishing leather or a synthetic leather replacement material (referred to below as leather for the sake of simplicity) with a purely aqueous system which is free of organic solvents and in which certain aqueous polymer dispersions are used in the bottoming and seasoning procedures.

Tanned, fatliquored raw leather, which may or may not be colored, is finished (coated) in order to give it the desired appearance, especially handle, and the required allround fastnesses, eg. resistance to flexing, water fastness, fastness to wet rubbing and fastness to dry rubbing. To date, these properties could only be achieved optimally using systems which contain organic solvents. The modern requirements with respect to health and environmental protection have, however, made it necessary to effect leather finishing with purely aqueous systems. Attempts in this direction to date have so far been unsatisfactory because it has never been possible to achieve all of the required properties.

It is an object of the present invention to provide a purely aqueous leather-finishing process which completely achieves the above aims.

We have found that this object is achieved by a process wherein a dispersion of two or more chemically different copolymers is used in the bottoming procedure, and a copolymer dispersion containing a divalent metal ion is used in the seasoning procedure, as defined in the claim.

The present invention accordingly relates to a process for finishing leather or a synthetic leather replacement material by applying a bottoming based on an aqueous acrylic resin dispersion, drying the coating and then applying a season containing an aqueous styrene/acrylate dispersion, wherein the dispersion used in the bottoming procedure comprises one or more copolymers (a) which contain, as copolymerized units, from 30 to 85% by weight of a $C_2$–$C_6$-alkyl acrylate or methacrylate, from 1 to 8% by weight of a carboxyl-containing monomer and from 7 to 65% by weight of one or more monomers, which are copolymerizable with the above monomers, from the group comprising acrylonitrile, acrylamide, methacrylamide, vinyl chloride, vinyl acetate and styrene, the percentages being based on the copolymer, and a copolymer (b) which contains, as copolymerized units, from 50 to 90% by weight of vinylidene chloride, from 10 to 50% by weight of a $C_2$–$C_4$-alkyl acrylate or methacrylate and from 1 to 5% by weight of N-methylolacrylamide or -methacrylamide which carries a group capable of crosslinking the copolymer, with or without from 1 to 5% by weight of acrylamide or methacrylamide, the percentages being based on the copolymer, or the composition contains, in dispersed form, from 50 to 90% by weight of vinyl chloride and from 10 to 50% by weight of a $C_1$–$C_4$-alkyl acrylate or methacrylate as well as from 0 to 5% by weight of acrylamide or methacrylamide in the ratio a:b of from 2:1 to 5:1, and the season used is a dispersion which contains a divalent metal ion and, in dispersed form, a copolymer (c) which contains, as copolymerized units, from 20 to 40% by weight of styrene, from 50 to 75% by weight of one or more $C_1$–$C_6$-alkyl acrylates or methacrylates, from 1 to 10% by weight of acrylic acid or methacrylic acid and from 1 to 5% by weight of N-methylolacrylamide or -methacrylamide which carries a group capable of crosslinking the copolymer, the percentages being based on the copolymer.

If the conditions stated above and described in more detail below are maintained, satisfactory finished leather is obtained whose specific properties can be established by varying the composition of the dispersions and the other relevant conditions, such as the temperature program in the drying and plating procedures.

Bottoming is carried out using a dispersion which contains one or more copolymers (a) and a copolymer (b). (a) and (b) are present in the ratio of from 2:1 to 5:1, preferably from 2:1 to 4.5:1, and together constitute from 30 to 70, preferably from 35 to 60, % by weight of the dispersion.

Copolymer (a) is a typical acrylic resin whose composition is known to those skilled in the art. It contains from 30 to 85, preferably from 60 to 75, % by weight of a $C_2$–$C_6$-alkyl acrylate or methacrylate, preferably ethyl, n-propyl or n-butyl acrylate, as a monomer, together with from 1 to 8% by weight of a carboxyl-containing monomer, such as acrylic acid, methacrylic acid, crotonic acid, maleic acid or acrylamidoglycolic acid. The copolymer preferably contains these comonomers as copolymerized units in an amount of from 2 to 5% by weight. Acrylic acid is a preferred comonomer.

Furthermore, comonomers which are copolymerizable with the above monomers are present in amounts of from 7 to 65, preferably from 20 to 38, % by weight; these are, in particular, acrylonitrile, acrylamide, methacrylamide, vinyl chloride, vinyl acetate and/or styrene.

Copolymer (b) contains, as the principal component, from 50 to 90, preferably from 55 to 70, % by weight of vinylidene chloride as copolymerized units. It also contains from 10 to 50, preferably from 25 to 40, % by weight of a $C_2$–$C_4$-alkyl acrylate or methacrylate, preferably ethyl or butyl acrylate.

Specific examples of crosslinking comonomers are N-methylolacrylamide and N-methylolmethacrylamide; such a comonomer is present, as copolymerized units, in an amount of from 1 to 5, preferably from 1 to 3, % by weight.

Copolymer (b) can, if required, also contain small amounts, ie. from 1 to 5, preferably from 1 to 3, % by weight, of acrylamide or methacrylamide as copolymerized units.

In the bottoming dispersion, the copolymer (a) can consist of a mixture of two copolymers as defined under (a), based on the total amount. Where a second copolymer is used, this is preferably one which has the composition described under (a) and contains from 65 to 85% by weight of one of the above alkyl acrylates or methacrylates. This makes the bottom softer.

The dispersion for the subsequent seasoning of the bottomed leather contains a salt of a divalent metal, eg. of zinc, cadmium, calcium or magnesium, which effects ionic crosslinking of the polymers present in the dispersion. Advantageously, the salts used are the chlorides, sulfates, acetates, nitrates, oxalates or carbonates. In the case of zinc and magnesium, it is also possible to employ zinc oxide or magnesium oxide. The metal compound is advantageously present in an amount of from 0.3 to 3, preferably from 0.5 to 2, % by weight, based on the above dispersion.

The copolymer (c) employed contains from 20 to 40% by weight of styrene, from 50 to 75% by weight of one or more $C_1$–$C_6$-alkyl acrylates or methacrylates, preferably methyl, ethyl and/or n-butyl acrylate, from 1 to 10, preferably from 2 to 9, % by weight of acrylic acid or methacrylic acid and from 1 to 5, preferably from 2 to 4, % by weight of a monomer capable of effecting covalent crosslinking, eg. N-methylolacrylamide or N-methylolmethacrylamide.

The aqueous dispersion used in the seasoning procedure advantageously contains from 10 to 50, preferably from 15 to 30, % by weight of copolymer (c).

In a preferred embodiment in industry, the dispersion (c) used for the season contains from 0.5 to 20, preferably from 2 to 8, % by weight of acrylate-modified shellac and from 0.5 to 3% by weight of thickeners based on polyglycol polyurethanes, vinylpyrrolidone or high molecular weight copolymers of acrylic acid, the percentages being based on the total weight.

Conventional additives may of course also be present, the amount of these being from 1 to 10, preferably from 1 to 6, % by weight, based on the dispersion. These additives include high boiling polyglycols, phthalates, ethylene glycol or natural or synthetic waxes as plasticizers, as well as fungicides, such as the Na salt of diazeniumdioxycyclohexane.

These additives may also be present in the bottoming dispersion, as can be seen from the Examples.

We have found that particularly advantageous allround fastnesses are obtained if the copolymer (b) used comprises from 50 to 90, preferably from 65 to 85, % by weight of vinyl chloride and from 10 to 50, preferably from 15 to 35, % by weight of a $C_1$–$C_4$-alkyl acrylate or methacrylate as well as from 0 to 5, preferably from 0 to 3, % by weight of acrylamide or methacrylamide.

Surprisingly, the consequence of this simplification is that leather finished by this process, in addition to possessing the conventional allround fastnesses, is stable to amines, ie. the film applied does not yellow under the action of amine. This advantageous result, ie. amine resistance in addition to the other allround fastnesses, such as fastness to water, resilience, adhesion to the leather, lightfastness and shelf life at high temperatures, could not be foreseen.

The resistance of the novel leather finish to free amines is particularly advantageous with regard to leather used for shoe manufacture, where polyurethane foam is produced on the upper leather to form soles, and, for example, in the case of polyurethane foam fillings for upholstery leather.

Otherwise, the leather is finished with the novel dispersion in a conventional manner.

First, the bottoming dispersion is plush-wheeled, brushed, poured or sprayed onto the leather in an amount such that from 20 to 70 g of solids are applied per $m^2$ of leather area, and the material is dried at from 60° to 80° C. for a few minutes. The bottoming dispersion may also be applied in several steps, with intermediate drying between the steps.

The dispersion for the final season is then applied in a conventional manner, in an amount corresponding to 10–30 g of solids per $m^2$ of leather. The material is first dried at from 60° to 80° C., treated at from 140° to 170° and, if required, then plated hydraulically at from 80° to 100° C. under reduced pressure.

It is of course possible to employ commercial pigment formulations and/or dyes in the bottoming and seasoning dispersions. Advantageously, the pigment formulation and/or commercial dye is added in an amount of from 1 to 5 g per 10 g of solids present in the dispersions.

In particular, it should be pointed out that, in order to achieve good allround fastnesses, it is advantageous if the bottomed and seasoned leather is dried thoroughly. Moreover, hot plating of the dry season is particularly advantageous.

Thorough drying is, for example, drying in a conventional drying tunnel at from 50° to 90° C., preferably from 60° to 80° C., for from 1 to 5, preferably from 2 to 3, minutes. Hot plating is, for example, plating of the leather at from 90° to 180° C., preferably from 120° to 170° C., with a conventional continuous plating machine.

The Examples which follow illustrate the invention. Parts are by weight.

EXAMPLES

The following dispersions were employed:

1. Examples of aqueous dispersions of a copolymer (a):

(a1)
- 70 parts of n-butyl acrylate
- 13 parts of acrylonitrile
- 13 parts of styrene
- 2 parts of acrylic acid
- 2 parts of methacrylamide Dispersion with a solids content of 50%

(a2)
- 32 parts of n-butyl acrylate
- 36 parts of vinyl chloride
- 30 parts of vinyl acetate
- 2 parts of acrylic acid Dispersion with a solids content of 50%

(a3)
- 67 parts of n-butyl acrylate
- 29 parts of styrene
- 2 parts of acrylic acid
- 2 parts of acrylamide Dispersion with a solids content of 50%

(a4)
- 76.5 parts of n-butyl acrylate
- 17.5 parts of acrylonitrile
- 4 parts of acrylic acid
- 2 parts of methacrylamide Dispersion with a solids content of 40%.

The copolymer (a4) is particularly useful as a mixture with a copolymer (a1), (a2) or (a3).

2. Examples of aqueous dispersions of a copolymer (b):

(b1)
- 80 parts of vinyl chloride
- 20 parts of methyl acrylate

Dispersion with a solids content of 42.0%

(b2)
- 64.3% of vinyl chloride
- 34.5% of butyl acrylate
- 1.2% of acrylamide

Dispersion with a solids content of 50.0%

(b3)
- 58.2% of vinyl chloride
- 40.6% of butyl acrylate
- 1.2% of acrylamide

Dispersion with a solids content of 50.0%

(b4)
64 parts of vinylidene chloride
33 parts of ethyl acrylate
1 part of methacrylamide
2 parts of N-methylolmethacrylamide
Dispersion with a solids content of 45%

(b5)
85 parts of vinylidene chloride
12 parts of butyl acrylate
2 parts of N-methylolmethacrylamide
1 part of acrylamide Dispersion with a solids content of 45%

(b6)
88 parts of vinylidene chloride
10 parts of ethyl acrylate
2 parts of N-methylolacrylamide Dispersion with a solids content of 55%

3. Examples of aqueous dispersions of a copolymer (c):

(c1)
35 parts of n-butyl acrylate
30 parts of styrene
25 parts of methyl methacrylate
1.5 parts of N-methylolmethacrylamide
8.5 parts of acrylic acid Dispersion with a solids content of 40% and additionally containing 1.5% by weight of zinc chloride (c2)
33 parts of styrene
40 parts of n-butyl acrylate
18 parts of methyl methacrylate
7 parts of acrylic acid
2 parts of N-methylolmethacrylamide Dispersion with a solids content of 40% and additionally containing 1.3% by weight of zinc oxide (c3)
38 parts of styrene
33 parts of butyl acrylate
20 parts of methyl methacrylate
7 parts of acrylic acid
2 parts of N-methylolmethacrylamide Dispersion with a solids content of 40% and additionally containing 1.3% by weight of zinc oxide (d) Comparison:
As in the case of (c3), except that the N-methylolmethacrylamide is replaced by 40 parts of styrene.

Use Examples

EXAMPLE 4

Bottoming dispersion:
450 parts of dispersion (a1)
250 parts of dispersion (a4)
5 parts of the Na salt of diazeniumdioxycyclohexane as the fungicide (30% strength aqueous solution)
45 parts of a 30% strength wax emulsion
250 parts of dispersion (b1)

Solids content: 46%
pH: 7.1–7.8

EXAMPLE 5

Bottoming dispersion:
450 parts of dispersion (a3)
250 parts of dispersion (a4)
5 parts of the Na salt of diazeniumdioxycyclohexane as the fungicide (30% strength aqueous solution)
45 parts of a 30% strength wax emulsion
250 parts of dispersion (b2)

Solids content: 46.5%
pH: 7.1–7.8

EXAMPLE 6

Bottoming dispersion:
450 parts of dispersion (a1)
5 parts of the Na salt of diazeniumdioxycyclohexane as the fungicide (30% strength aqueous solution)
250 parts of dispersion (a4)
50 parts of a 30% strength wax emulsion
250 parts of dispersion (b4)

Solids content: 45%
pH: 7.1–7.5

EXAMPLE 7

Seasoning dispersion:
200 parts of water
30 parts of ethylene glycol
10 parts of the above fungicide
15 parts of the thickener based on a polyglycol ether-polyurethane
80 parts of acrylate-modified shellac (40% aqueous solution)
615 parts of dispersion (c1)
50 parts of a 38% strength wax emulsion Solids content: 31%
pH: 8.5–8.8 (adjusted with $NH_3$)

Examples of use on leather

EXAMPLE I

With the aid of a spraygun, full grain leather was bottomed with two coatings of the following formulation:
500 parts of water,
50 parts of the dye C.I. Pigment Red 101 (as a pigment formulation),
350 parts of the above bottoming dispersion (Example 4),
50 parts of Montan wax emulsion and
50 parts of the dye C.I. Acid Brown 50 (as a fluid formulation).

The leather sprayed in this manner was dried at 70° C. after each spray coating and plated at 70° C. and under 50 bar after the first spray coating. Amount applied: 45 g of solids per $m^2$.

The leather bottomed in this manner was then seasoned with a formulation of the following composition:
100 parts of water,
3 parts of silicone-based wax and
100 parts of seasoning dispersion (Example 7).

The formulation was sprayed on in two coatings by means of a spraygun, drying was carried out at 70° C. after each coating, and the leather was then plated at 170° C. on a continuous plating press.

The leather obtained possesses the sensory properties (handle, gloss, etc.) desired for an upper leather and also has the properties required in practice, eg. resistance to water, resilience and amine-resistance.

EXAMPLE II

Nappa leather for clothing was coated with the following bottoming formulation:

440 parts of water,
100 parts of the dye C.I. Pigment Red 7 (as a pigment formulation),
350 parts of the above bottoming dispersion (Example 5),
50 parts of Montan wax emulsion and
60 parts of the dye C.I. Acid Red 227 (fluid formulation).

Amount applied: 55 g of solids per $m^2$

The leather treated in this manner was dried at 70° C. after each of the three spray coatings.

It was then sprayed with the following seasoning formulation:

500 parts of water,
15 parts of silicone-based wax,
465 parts of seasoning dispersion (Example 7) and
20 parts of the dye C.I. Acid Red 227 (fluid formulation).

Two coatings were sprayed on, the leather being dried at 70° C. after each coating. The amount applied in the two coatings corresponded to 35 g of solids per $m^2$. The leather was plated at 125° C. on a continuous plating machine and then at 90° C. on a hydraulic press.

The resulting leather exhibited all the properties required for clothing leather, eg. handle, abrasion-resistance and fastness to water.

EXAMPLE III

Upholstery leather was coated, in a similar manner, with a bottoming mixture of the following composition:

500 parts of water,
75 parts of the dye C.I. Pigment Black 7 (as a pigment formulation),
25 parts of the dye C.I. Acid Black 63 (fluid formulation),
350 parts of bottoming dispersion (Example 5) and
50 parts of wax (oxidized polyethylene wax).

Amount applied: 60 g of solids per $m^2$.

Two coatings of this mixture were sprayed on, the leather was then dried at 80° C. and plated at this temperature, a further two coatings were sprayed on and further drying was carried out at 70° C.

Thereafter, the following seasoning formulation was sprayed on:

500 parts of water,
30 parts of Montan wax emulsion and
470 parts of seasoning dispersion (Example 7).

Two coatings were sprayed on by means of a spray gun, and each coating was dried at 70° C. and plated at 150° C. on a continuous plating machine, and further plated at 90° C. on a hydraulic plating press.

The resulting leather had all the properties desirable for upholstery leather, eg. fastness to rubbing, resilience, lightfastness, fastness to chafing, amine-resistance and fastness to hot plating.

EXAMPLE IV

Buffered leather for shoes

Bottoming mixture:

400 parts of water,
400 parts of bottoming dispersion (Example 4),
50 parts of Montan wax emulsion and
150 parts of C.I. Pigment White 6 (as a pigment formulation).

One coating of this bottoming mixture was applied onto the leather by means of a plush pad, the leather was dried at 70° C. and plated at this temperature, a further coating was applied with the plush pad and two coatings were then applied by means of a spraygun, each coating being dried at 70° C.

Amount applied: 80 g of solids per $m^2$.

The bottomed leather was then coated with the following seasoning formulation:

500 parts of water,
15 parts of silicone-based wax,
465 parts of seasoning dispersion (Example 7) and
20 parts of C.I. Pigment White 6 (as a pigment formulation).

Amount applied: 30 g/$m^2$

Two coats of this formulation were applied by means of a spraygun, and drying was carried out at 70° C. and plating at 100° C. on a continuous plating machine. The resulting leather possessed the properties desirable for upper leather. It is lightfast, amine-resistant, resistant to water and sufficiently resilient.

EXAMPLE V

Two coatings of the following formulation were sprayed onto full grain leather, each coating being dried at 70° C. and then plated at this temperature:

500 parts of water,
50 parts of the dye C.I. Pigment Red 101 (as a pigment formulation),
350 parts of bottoming dispersion (Example 6),
50 parts of Montan wax emulsion and
50 parts of the dye C.I. Acid Brown 50 (as a fluid formulation).

The treatment was continued until 50 g of polymer had been applied per $m^2$ of leather.

The bottomed leather was then seasoned with a formulation of the following composition:

100 parts of water,
3 parts of silicone-based wax and
100 parts of the above seasoning dispersion.

The resulting leather is fast to wet rubbing and can be subjected to mechanical stress without the season peeling off.

EXAMPLE VI

The procedure described in Example V was followed (clothing leather), except that in this case the bottoming dispersion used (40 g/$m^2$) comprised 440 parts of water,
400 parts of the dye C.I. Pigment Red 7 (as a pigment formulation),
350 parts of bottoming dispersion (Example 6),
50 parts of Montan wax emulsion and
100 parts of the dye C.I. Acid Red 227 (fluid formulation), and the season used, which was sprayed on in three coats, each coating being dried, comprised 500 parts of water,
25 parts of silicone-based wax,
500 parts of the above seasoning dispersion and
20 parts of the dye C.I. Acid Red 227 (fluid formulation).

The resulting leather exhibited all the properties desirable for clothing purposes, eg. handle, abrasion-resistance and fastness to water.

EXAMPLE VII

Goat leather was bottomed in a similar manner with a mixture (30 g/m$^2$) comprising
570 parts of water,
17.5 parts of the dye C.I. Pigment Black 7 (as a pigment formulation),
7.5 parts of the dye C.I. Acid Black 63 (fluid formulation),
350 parts of bottoming dispersion (Example 6) and
50 parts of oxidized polyethylene wax,
two coatings of the mixture being sprayed on. Thereafter, the leather was seasoned with a mixture comprising
500 parts of water,
30 parts of Montan wax emulsion and
470 parts of the above seasoning dispersion (15 g/m$^2$).

The resulting leather has all the properties preferable for handbags and briefcases.

Examples V, VI and VII were repeated, except that the stated bottoming and seasoning dispersions were replaced by the following dispersions.

A bottoming dispersion containing (a2), (a4) and (b5) as well as (a1), (a4) and (b4) and the remaining components as described in Example 6, and a seasoning dispersion containing (c2), (c3) and (d) (comparison) and the remaining components as described in Example 7.

The results are essentially the same, but where dispersion (b4) is used in the bottoming dispersion the resilience of the leather is less satisfactory (somewhat hard), and this can be attributed to the high content of vinylidene chloride. The use of dispersion (d) (comparison) in the coating dispersion (no crosslinking agent present) gives a leather which is substantially less fast to water.

We claim:

1. A process for finishing leather or a synthetic leather substitute which comprises applying a bottoming based on an aqueous acrylic resin dispersion, drying the coating and then applying a season containing an aqueous styrene/acrylate dispersion, wherein the dispersion used in the bottoming procedure comprises one or more copolymers (a) which contain, as copolymerized units, from 30 to 85% by weight of a $C_2$–$C_6$-alkyl acrylate or methacrylate, from 1 to 8% by weight of a carboxyl-containing monomer and from 7 to 65% by weight of one or more monomers, which are copolymerizable with the above monomers, and which are selected from the group consisting of acrylonitrile, acrylamide, methacrylamide, vinyl chloride, vinyl acetate and styrene, the percentages being based on the copolymer, and a copolymer composition (b) the composition which contains, as copolymerized units, from 50 to 90% by weight of vinylidene chloride, from 10 to 50% by weight of a $C_2$–$C_4$-alkyl acrylate or methacrylate and from 1 to 5% by weight of N-methylolacrylamide or -methacrylamide which carries a group capable of crosslinking the copolymer, the percentages being based on the copolymer, or said composition (b) contains, in dispersed form, from 50 to 90% by weight of vinyl chloride and from 10 to 50% by weight of a $C_1$–$C_4$-alkyl acrylate or methacrylate as well as from 0 to 5% by weight of acrylamide or methacrylamide in the ratio a:b of from 2:1 to 5:1, and the season used is a dispersion which contains a divalent metal ion in the form of an ionic compound and selected from the group of chlorides, sulfates, acetates, nitrates, oxalates or carbonates of zinc, cadmium, calcium or magnesium or oxides of zinc or magnesium and, in dispersed form, a copolymer (c) which contains, as copolymerized units, from 20 to 40% by weight of styrene, from 50 to 75% by weight of one or more $C_1$–$C_6$-alkyl acrylates or methacrylates, from 1 to 10% by weight of acrylic acid or methacrylic acid and from 1 to 5% by weight of N-methylolacrylamide or -methacrylamide which carries a group capable of crosslinking the copolymer, the percentages being based on the copolymer.

2. The process according to claim 1 wherein said copolymer composition (b) further comprises 1 to 5% by weight of acrylamide or methacrylamide.

* * * * *